United States Patent [19]

Varich et al.

[11] 4,103,745

[45] Aug. 1, 1978

[54] PORTABLE DRILLING MACHINE

[76] Inventors: Mikhail Sidorovich Varich, ulitsa Mosfilmovskaya, 25, kv. 58; Vladimir Konstantinovich Grigoriev, 1 Streletsky pereulok, 3, kv. 24, both of Moscow; Viktor Dmitrievich Chugunov, Solnechnogorsky raion, Povarovo, poselok 2, 4, kv. 13, Moskovskaya oblast; Alexei Pavlovich Dmitriev, ulitsa Udaltsova, 16, kv. 63, Moscow; Boris Nikolaevich Kutuzov, Sirenevy bulvar, 43, kv. 42, Moscow; Rudolf Genrikhovich Shmidt, 2 Spasonalivkovsky pereulok, 16, kv. 91, Moscow; Isaak Emmanuilovich Narinsky, Khimki, ulitsa Leningradskaya, 16, kv. 40; Alexandr Adolfovich Vukkert, Solnechnogorsky raion, Povarovo, poselok 2, 12, kv. 51, both of Moskovskaya oblast; Yakov Isaakovich Shnapir, 3 Pryadilnaya ulitsa, 7, kv. 111, Moscow; Viktor Alexeevich Soldatov, Solnechnogorsky raion, Povarovo, poselok 2, 7, kv. 7; Vladimir Ilich Antoshenkov, Solnechnogorsky raion, poselok Krjukovo, ulitsa Lenina, 29, kv. 59, both of Moskovskaya oblast, all of U.S.S.R.; Pavel Ivanovich Deev, deceased, late of Moskovskaya oblast, U.S.S.R.; by Alexandra Ivanovna Deeva, administratrix, Mytischi, 2 Parkovaya ulitsa, 5, Moskovskaya oblast, U.S.S.R.

[21] Appl. No.: 722,677

[22] Filed: Sep. 13, 1976

[51] Int. Cl.[2] ..... B25D 17/14

[52] U.S. Cl. ..... 173/57; 173/152; 173/147

[58] Field of Search ..... 173/57, 53, 147, 152; 254/29, 30, 31; 175/85

[56] References Cited

U.S. PATENT DOCUMENTS

| | | | |
|---|---|---|---|
| 3,708,020 | 1/1973 | Adamson | 173/152 |
| 3,736,993 | 6/1973 | West | 173/152 |
| 3,741,318 | 6/1973 | Klein et al. | 173/152 |
| 3,857,451 | 12/1974 | Williams | 173/152 |
| 3,867,989 | 2/1975 | Hisey et al. | 173/147 |
| 3,915,243 | 10/1975 | Hisey et al. | 173/147 |
| 3,949,818 | 4/1976 | Russell | 173/57 |

*Primary Examiner*—Robert A. Hafer

*Attorney, Agent, or Firm*—Lackenbach, Lilling & Siegel

[57] ABSTRACT

The present invention relates to drilling equipment. The portable drilling machine comprises a derrick having longitudinal racks guiding a vertical traverse mechanism carrying a traverse having a means designed for rotation of a drill pipe during the drilling operation, sand pipe being positioned longitudinally in the derrick in alignment with the drilling axis; a pulldown unit connected through a closed flexible transmission with the vertical traverse mechanism and the traverse to feed, during the working run thereof, the drill pipe to the bottom of the hole and, during the reverse run thereof, raise the drill pipe, and a clamp designed for gripping the drill pipe on completion of the working run of the vertical traverse mechanism and the traverse and being mounted at the base of the derrick. The means for rotation of the drill pipe is designed as a power-driven rotating chuck mounted in the traverse, said chuck grips the drill pipe during the drilling operation, and can during an idle run, when it is unclenched together with the vertical traverse mechanism, regrip the pipe while the drill pipe is held by a clamp. Such drilling machines can make vertical and angle holes to the full depth by using only one long drill pipe in a most efficient manner as to rotation rate thereof and load on the bit, which makes such a drilling machine a high-capacity design.

2 Claims, 7 Drawing Figures

PORTABLE DRILLING MACHINE

This invention relates to drilling equipment and more particularly to portable drilling machines designed for drilling holes for mining and geological exploration and for the oil and gas industry.

The present invention can be utilized to the greatest advantage for drilling vertical and angle blast holes in the mining industry.

Prior art portable drilling machines (e.g. Author's Certificate No. 345,262, Cl. E21cl/14, USSR) comprise a crawler vehicle having a machinery house, and a derrick mounted on this vehicle and having longitudinal racks guiding a vertical traverse mechanism carrying a traverse having a means designed for the rotation of a drill pipe with a drill bit positioned longitudinally in the derrick in alignment with the drilling axis.

A pulldown unit is mounted at the base of the derrick, and is connected by a closed flexible transmission with the vertical traverse mechanism and the traverse to provide, during the working run thereof along the racks, for feeding the drill pipe to the bottom of the hole and for pulling the drill pipe, during the reverse run.

Further, a clamp intended for gripping the drill pipe is installed at the base of the derrick, is embodied as a wrench for spinning operations.

In the prior art portable drilling machines, a rotary drive means is provided wherein there is a motor in alignment with the drill pipe, having a reducing gear wherein the outlet shaft drives a spindle which is attached to the traverse and to which the drill pipe is screwed.

The drilling operation is carried out by the aforesaid drilling machines as follows:

After the spotting operation, the rotary drive means and the pulldown unit are put into operation to lower the vertical traverse mechanism and the traverse to the bottom of the hole and thus to make a hole. After drilling to a depth equal to the length of the drill pipe, drilling is interrupted, the compressor supplying a scavenging agent through the hollow drill pipe is switched off, the spindle of the traverse is disconnected from the drill pipe, the pulldown mechanism is put into operation again, and the vertical traverse mechanism and the traverse run back to the top of derrick.

A pipe-handling apparatus then takes the next drill pipe to the drilling axis, the drill pipe being first screwed to the spindle of the traverse and then to the drill pipe in the hole. The drilling operation continues then to a depth equal to the length of the second pipe. All the aforesaid operations are then repeated or make connection of the next, third pipe.

On completion of drilling to a preset depth (19–20 m), drilling discontinues, the compressor is switched off, and the pulldown unit raises the vertical traverse mechanism and the traverse coupled with drill pipes forming a drill string to the length of one drill pipe.

Thereafter the upper pipe is spinned out from the lower pipe and is taken by the pipe-handling apparatus. The vertical traverse mechanism, the traverse, and the rotary drive means move from the upper position thereof to the lower one thereof, the spindle is screwed to the second pipe, and the aforesaid operations are repeated.

All operations are then repeated in pulling the third drill pipe from the hole.

The main disadvantage of the aforesaid drilling machines is that in making a hole, two or three drill pipes have to be successively added, and on completion of drilling, the resulting drill string has to be disconnected and pipe sections have to be taken by the pipe-handling apparatus. This operation takes about 15 percent of the working time, which thus considerably lowers the actual capacity of the drilling machine.

Moreover, because addition and removal of pipes are carried out with the compressor switched off, the arms of the bit become plugged by cuttings, which wear the arms faster and makes the bit life shorter.

In some of the prior art portable drilling machines the aforesaid disadvantages have been eliminated.

In such drilling machines, the derrick is lenghtened to provide for positioning a drill pipe whose length is sufficient for drilling without adding pipes, which eliminates the unproductive loss of time for spinning operations and makes bit life longer, because the cutter arms are no longer plugged up.

The aforesaid drilling machines, however, also have a great number of serious disadvantages impairing large scale utilization thereof at mining enterprises.

The main disadvantages are as follows.

The aforesaid drilling machines cannot be utilized in a most efficient drilling manner (rotating speed of drill pipe and load on drill pipe) because of considerable lateral and longitudinal drill pipe vibration passing into resonance vibration transmitted to the entire drilling machine.

This phenomenon arises owing to the upper position of the vertical traverse mechanism having a heavy (7–8 tons) rotary drive means which applies the torque and the load on the bit to the top of a long 22 meter drill pipe which acquires a great curvature; therefore, at a high rotating speed it loses stability that may cause an emergency situation.

The upper position of the vertical traverse mechanism carrying the heavy rotary drive means makes drilling and angle hole impossible, because tilting the mast from the vertical will cause a considerable overturning moment. The upper position of the vertical traverse mechanism also makes it very difficult for the drilling machine to move within the bench with the mast raised to the vertical. This requires the lowering of the mast to the horizontal and subsequent raising for drilling a new hole.

Besides the aforesaid disadvantages, the embodiment of drilling machines with the upper position of the vertical traverse mechanism carrying the rotary drive means has caused a multiple increase in the weight and dimensions of drilling machines, unreasonably great investments to produce such heavy drilling machines, and the necessity for deposits to be developed by wide benches, which enlarges the overburden coefficient and considerably raises the cost of mining.

It is the main object of the present invention to provide a portable drilling machine designed for drilling vertical and angle boreholes to the full depth without the addition of drill pipes and at the most efficient rotating speeds and bit loads to raise the capacity of the drilling machine and, at the same time, to improve the dependability thereof and to increase the bit life.

It is an object of this invention to eliminate the aforesaid disadvantages.

These and other objects are attained in the invention according to which there is a drilling machine provided with a derrick having longitudinal racks guiding a vertical traverse mechanism carrying a traverse having a means designed for the rotation of a drill pipe connected to a bit and positioned in the derrick longitudinally in alignment with the drilling axis; a pulldown unit connected by a closed flexible transmission with the vertical traverse mechanism and the traverse to feed the drill pipe to the bottom of the hole during the working run thereof along the racks and to hoist the drill pipe during the idle run; and a clamp mounted at the base of the derrick and designed for gripping the drill pipe at the end of the working run of the vertical traverse mechanism. In accordance with the invention, the means for rotating the drill pipe is designed as a rotating drive chuck mounted in the traverse. Said chuck grips said drill pipe during the drilling operation and can during an idle run, when it is unclenched together with the vertical traverse mechanism, regrip the drill pipe while the pipe is held in position by the clamp.

Such a design permits the drilling of vertical and angle boreholes to the full depth by one drill pipe and thus eliminates excessive lateral pipe vibration and provides a most efficient manner of drill performance, raises speeds and, therefore, the capacity of the drilling machine, and makes the drilling machine more manoeuvrable and stable in moving within the bench because the vertical traverse mechanism having a traverse, and a means designed for the rotation of the drill pipe, can be lowered along the derrick to the position at the base thereof.

Moreover, according to the design the vertical traverse mechanism having a traverse and a means designed for the rotation of drill pipe can be lowered to a position at the base of the derrick which permits convenient inspection and repair of this mechanism even if an accident has happened during the drilling operation wherein the drill pipe connected to the drill bit is partly fed into the hole and cannot be taken by the pipe-handling apparatus.

Such a design also provides easy access to all the assemblies of the vertical traverse mechanism, which is the operating member of the drill going out of action most frequently.

In the preferred embodiment, a jaw chuck is used as the rotating chuck, the body of said chuck being at the same time the traverse designed as a ring carrying a hollow spindle on bearings, which permits free passage of the drill pipe, and has in the walls thereof radially positioned through ports to locate jaws mounted on a faceplate enveloping the spindle. The chuck is driveably engaged with the means for rotation of the drill pipe through a flexible coupling having an elastic shell connected to a flange rigidly attached to the outlet shaft of the reducing gear of the aforesaid means and to a bushing connected to the spindle through a slit.

Such a design permits fast and reliable connection of the drill pipe to the traverse, which increases the capacity of the drilling machine, while the application of the coupling eliminates the rigid connection of the means designed for rotation of the drill pipe to the traverse and protects this means from vibration originating in the drill pipe and the traverse.

Further, in the preferred embodiment additional racks are mounted in the derrick to guide a swivel attached at the top of drill pipe and to connect the hollow drill pipe with a scavenging agent feeding unit for cleaning cuttings from the hole.

Such a design permits a continuous feed of the scavenging agent into the bit throughout the period of making the hole, including the idle runs of the vertical traverse mechanism with the chuck in regripping the drill pipe, and therefore eliminates the possibility of the arms of the cutters being plugged up with cuttings, which considerably increases the bit life.

The pulldown unit designed for feeding and hoisting the drill pipe can comprise two drawworks each having a drive and brake drums, a flexible transmission connecting the aforesaid drums with the traverse and the vertical traverse mechanism through a system of blocks and tackles.

Such a design provides a continuous feed of the bit to the bottom of the hole by operating branches of an endless cable while the dead branches thereof hold the vertical traverse mechanism having the means designed for the rotation of drill pipe above the traverse with a preset clearing to eliminate the transfer of vibration from the drill pipe to this means. Further, such a design permits utilization of one pulldown unit for both feeding the drill pipe to the bottom of the hole and for hoisting it.

Below one embodiment is exemplified in detail in the accompanying drawings, of which:

Figure 1:
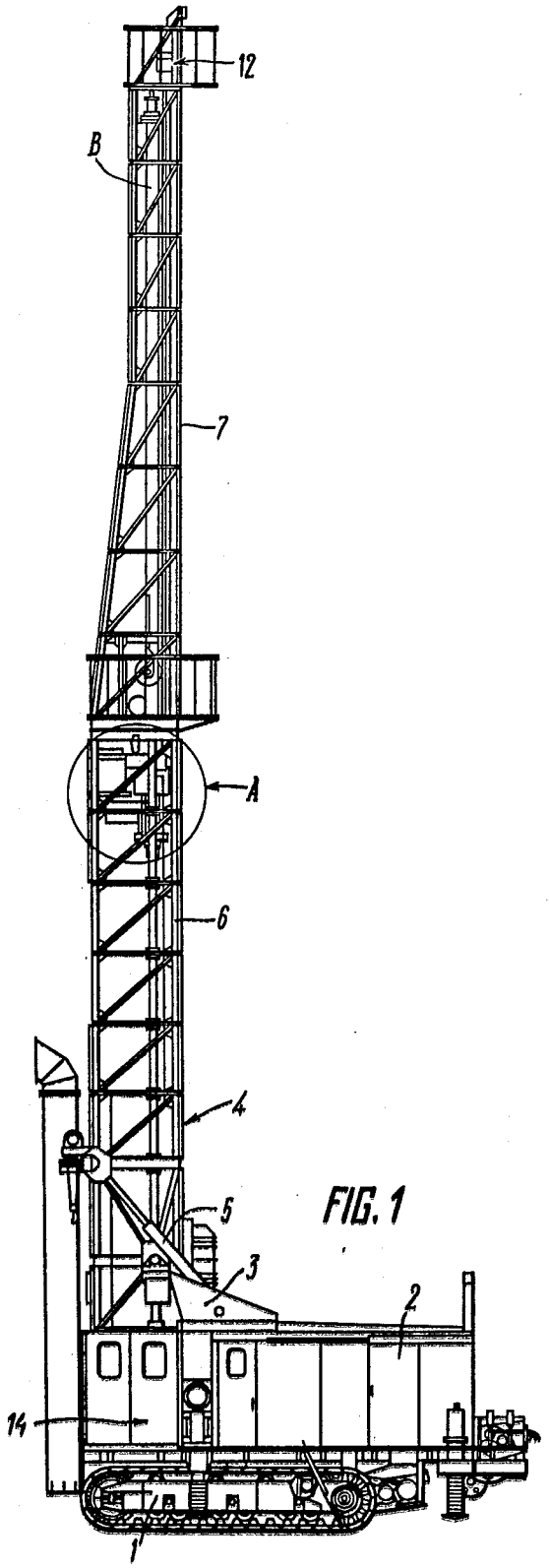
FIG. 1 is a an elevational view of a portable drilling machine embodying the invention.

Referring now to FIG. 1, a portable drilling machine is mounted on a crawler 1, each crawler being driven independently. A machinery house 2 enclosing equipment is mounted on the axes of the crawlers. On the frame of the machinery house 2 are mounted supports 3 on which a derrick 4 is mounted. Hydraulic cylinders 5 provide a means for raising and lowering the derrick to the operating position for vertical and angle drilling and to the horizontal or traveling position.

Derrick 4 is a welded structure comprising two rigidly connected pieces: a lower piece 6 and an upper piece 7.

Figure 2:
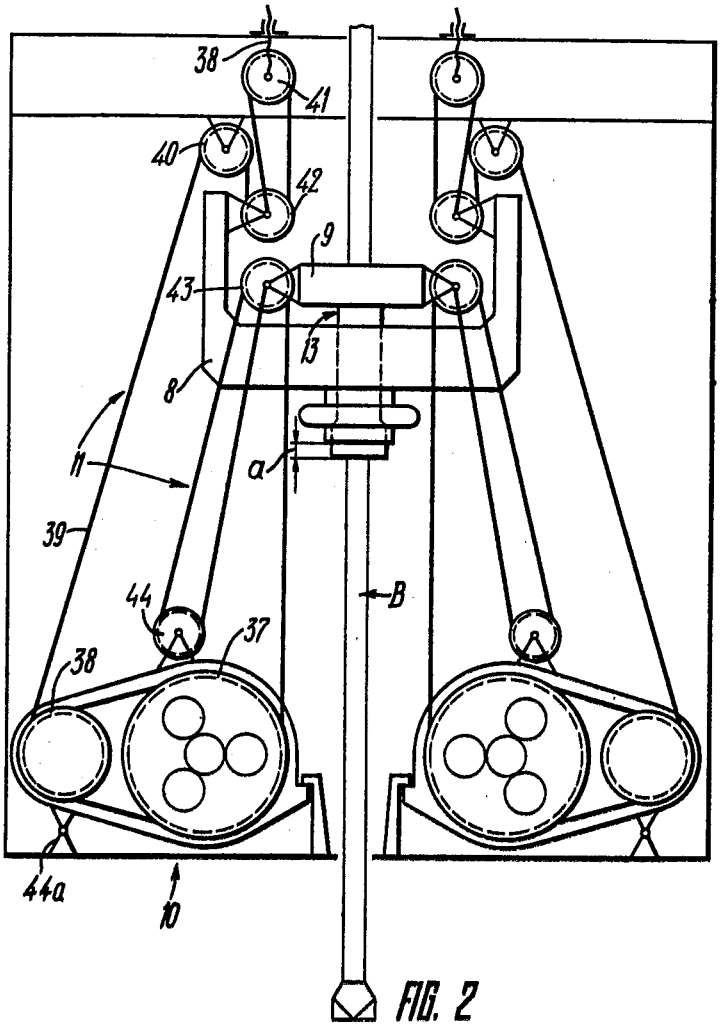
FIG. 2 is an enlarged view of the operating member of the portable drilling machine.

In the lower piece 6 of the derrick 4 are mounted longitudinal racks guiding a vertical traverse mechanism 8 (FIG. 2) with a traverse 9 having a means designed for rotation of a hollow drill pipe "B" with a drill bit. The drill pipe "B" is positioned longitudinally in the derrick 4 in alignment with the drilling axis.

In the lower piece 6 of the derrick 4 is also mounted a pulldown unit comprising two drawworks 10 connected by a closed flexible transmission 11 with the vertical traverse mechanism 8 and the traverse 9 to feed, during the working run thereof (downwards), the drill pipe "B" to the bottom of the hole and, during the reverse run thereof (upwards), to hoist the drill pipe or to regrip it.

Along the entire derrick 4 are mounted additional racks guiding a swivel 12 (FIG. 1) which attaches to the top of the drill pipe "B" and connects the hollow pipe with a scavenging-agent feeding device (not shown) for cleaning cuttings from the hole.

Figure 3:
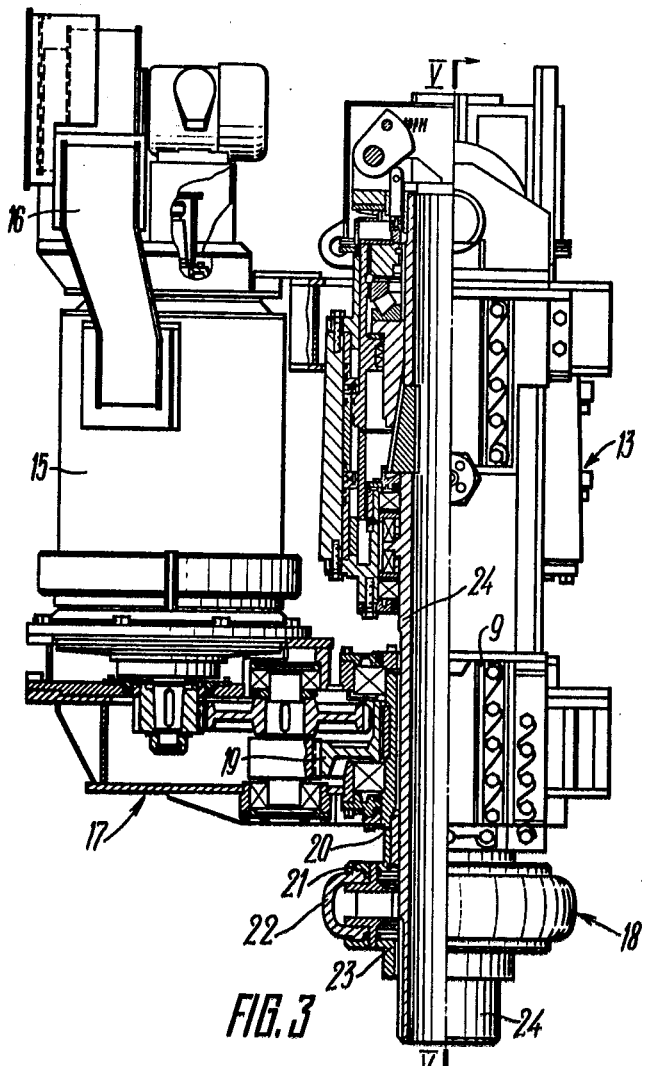
FIG. 3 is an enlarged elevational view of the portion A of FIG. 1 showing the vertical traverse mechanism, the traverse and the means designed the rotation of the drill pipe.
Figure 4:
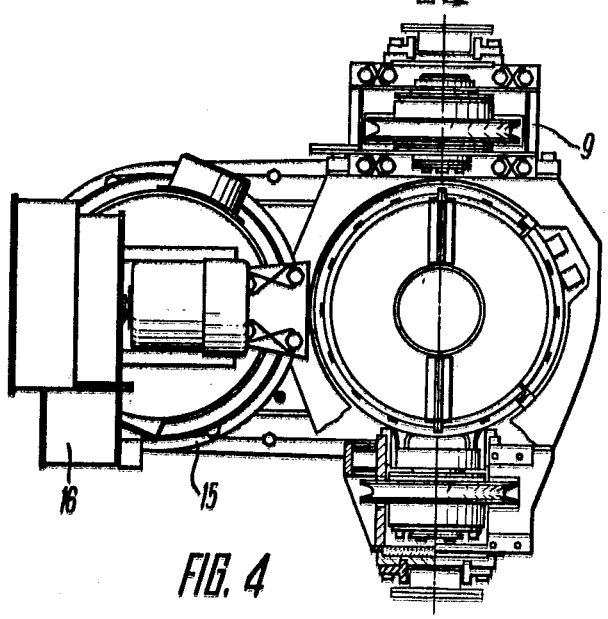
FIG. 4 is a top view of the vertical traverse mechanism and the rotary drive means of FIG. 3.

According to the invention, the means for rotating the drill pipe "B" is embodied as a rotating jaw chuck 13 (FIG. 3) mounted in the traverse. This chuck clamps the drill pipe "B" during the drilling operation and can, during an idle run, when it is unclenched, together with the vertical traverse mechanism 8, regrip the drill pipe while the pipe is held in alignment with the drilling axis by a clamp 14 (FIG. 1) mounted at the base of the derrick.

The jaw chuck 13 has a drive for its rotation comprising an electric motor 15 (FIG. 3), a ventilator 16 intended for cooling thereof, a reducing gear 17, and a flexible coupling 18 transmitting power from the reducing gear 17 to the jaw chuck 13.

The reducing gear 17 is embodied vertically and double.

The outlet pinion 19 of the reducing gear 17 is forced on a hollow shaft 20 ended with a flange 21 to which is attached an elastic shell 22 of the flexible coupling 18, which protects the electric motor 15 and the reducing gear 17 from axial and lateral vibrations of the drill pipe "B".

Figure 5:
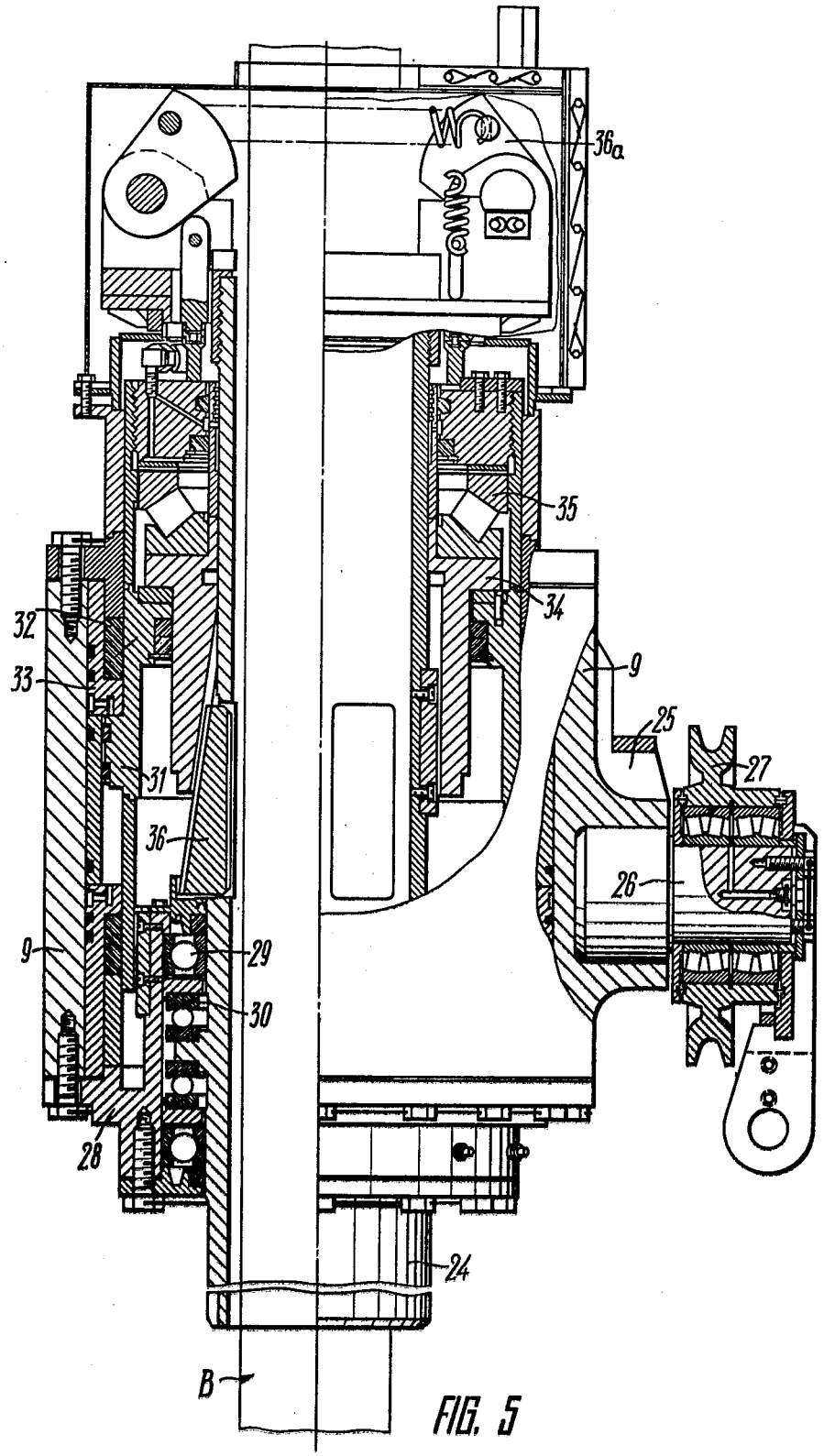
FIG. 5 is a cross sectional view taken along the line V—V of FIG. 3.

A splined collet 23 of a coupling 18 is connected to the hollow spindle 24 of the jaw chuck 13 to make the spindle rotate. The drill pipe "B" loosely passes inside the spindle 24 (FIG. 5).

The body of the jaw chuck 13 is formed by the annular traverse 9 having outer rectangular protrusions 25 placed in the racks of the vertical traverse mechanism 8. On the outside, the traverse is also provided with journals 26 on which are forced tension blocks 27 connected by a flexible transmission embodied as a system of blocks and tackles with the drawworks 10 (FIG. 2) of the pulldown unit.

From below, the traverse 9 is entered by a cover 28 in which is mounted a bearing assembly for the spindle 24 of the jaw chuck 13 to be installed. The bearing assembly comprises two radial 29 and two thrust 30 ball bearings.

Inside the traverse 9 is installed a circular piston 31 of a hydraulic cylinder, sealed with rings 32 against the outer motionless surface of a sleeve 33.

From inside the piston 31 is provided with a protrusion on which is placed a faceplate 34 having a thrust bearing 35 which is screwed tight from above by a nut. In the faceplate 34 are made three longitudinal slots in which are installed jaws 36 reinforced with a hard alloy and splines to attach faceplates 34 to the spindle 24. At the top of the spindle 24 are mounted eccentric jaws **36*a*** designed for clamping the pipe "B" if the pressure in the hydraulic cylinder drops.

The pulldown unit comprises two drawworks 10 (FIG. 2) and a system of three-fold blocks and tackles (left and right) and serves to load the drill pipe "B" by moving the vertical traverse mechanism 8, the traverse 9 and the jaw chuck 13 downwards and to move thereof back along the derrick during the regripping operation.

Each drawwork is provided with two drums: drive 37 and brake 38 mounted on bearings in a dismountable body.

The three-fold system of blocks and tackles is formed by a single cable successively passing around upper blocks 40 and 41, blocks 42 and 43 of the vertical traverse mechanism 8, lower blocks 44 and the drums 37 and 38 of the drawworks 10. One end of the cable 39 is fixed to the vertical traverse mechanism 8, the other to the traverse 9. Each drive drum 37 transmits to the cable 39 a fractive effort arising through friction between the drum and the cable, the friction force being created by preliminary tensioning of the downward branch of the cable 39 coiled along the ring grooves of the drums 37 and 38 of the drawworks 10.

During the drilling operation, the down-running branch of the cable 39 is tensioned by the weight of the vertical traverse mechanism 8, suspended in the derrick by the upper blocks 40 and 41, and by the weight of the drawworks 10, which can turn around pivots 44.

Clearing "*a*", which provides the proper mutual arrangement of the traverse and the vertical traverse mechanism during the drilling operation, is set up and maintained by cables passing through the upper blocks 40 and 41.

Figure 6:
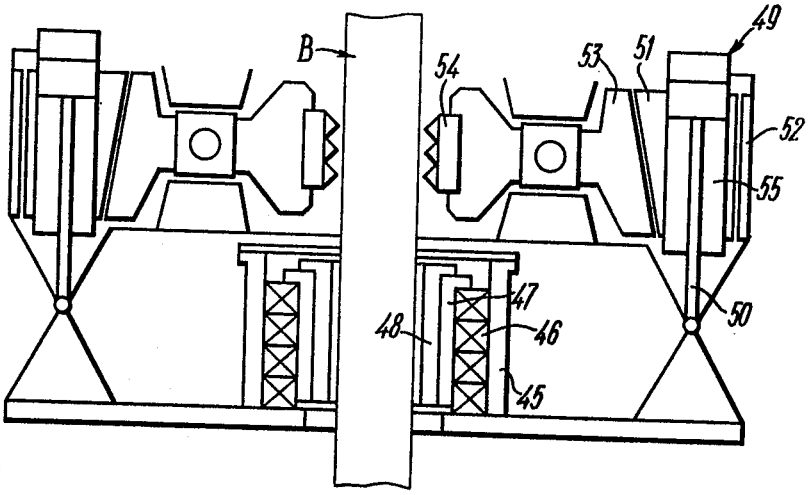
FIG. 6 is an elevational view of the clamp.

A clamp 14 (FIG. 1) is intended for holding the drill pipe "B" during regripping thereof by the jaw chuck 13 in making a hole as well as for centering thereof during the drilling operation. The clamp 14 comprises a body 45 (FIG. 6) wherein on rubber rings 46 is installed a bushing 47 enclosing replaceable brasses 48. Two hydraulic cylinders with pivotally attached rods 50 are also mounted in the body 45 of the clamp 14.

To the body of each hydraulic cylinder 49 is rigidly attached a wedge 51, one side thereof interacting with the thrust 52 of the side walls and the other or inclined side with the body 53 of the insert 54.

This body 53 reciprocates to clamp and release the drill pipe "B" by means of the inserts 54 which move along guiding grooves in the side walls. The rod-side hollows 55 of the hydraulic cylinders 49 work for clamping and the piston-side hollows for release.

A swivel 12 (FIG. 1) connects the drill pipe "B" with the compressor (not shown) to feed the scavenging agent to the bit and holds the drill pipe "B" in alignment with the drilling axis.

Figure 7:
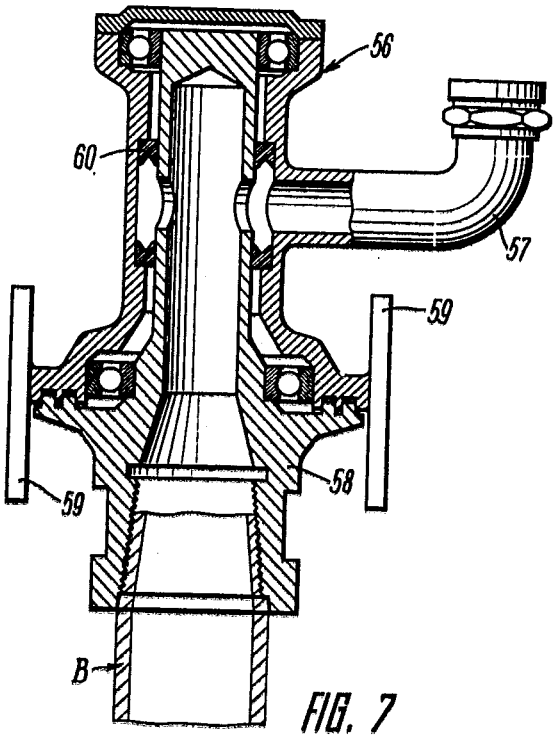
FIG. 7 is a cross sectional elevational view of the swivel.

The swivel 12 comprises a body 56 (FIG. 7) having a sleeve 57. A hollow spindle 58 connecting the body 56 of the swivel 12 with the drill pipe "B" is installed inside the body 56 on antifriction bearings. To hold the pipe "B" in alignment with the drilling axis, the swivel 12 is provided with two racks 59.

Sealing of the rotating spindle 58 with the body 56 of the swivel 12 is provided by the use of collars 60.

The portable drilling machine operates as follows:

Being located at the panel controlling the motion of the drilling machine, the operator sets up the machine at the preset site and raises the derrick 4, by using the hydraulic cylinders 5, to a preset position for vertical or angle drilling.

Initially, the swivel 12 and the vertical traverse mechanism 8 are in the uppermost positions thereof in the derrick 4.

On engaging the hydraulic drive of the jaw chuck 13, oil from the oil pump (not shown) enters into the hydraulic cylinder above the piston 31 (FIG. 5) which, as a result, moves downwards and affects the jaws 36 through a nut, thrust bearing 35, and faceplate 34. As a result, the jaws 36 protrude inside the spindle 24 through radial ports in the spindle and clamp the pipe "B".

The operator then switches on the electric motor 15 of the means designed the rotation of the drill pipe "B". The rotation of the shaft of the electric motor 15 is transmitted to the spindle 24 through pinions of the reducing gear and the flexible coupling 18, and then to the drill pipe "B" through the jaws 36.

At the same time the drive of the pulldown unit is engaged, this unit feeding the drill pipe "B" downwards by means of the system of blocks and tackles 11. The drive drums 37 of the drawworks 10 transmit the pulldown force to the cable 39 through friction of the cable 39 against the drum 37. The downrunning branch of the cable 39 is tensioned by the weight of the vertical traverse mechanism 8.

Contemporaneously with the drives of the means designed for rotation of the drill pipe and pulldown unit, a compressor is put into operation (not shown), wherefrom the scavenging agent, through the inlet sleeve 57 (FIG. 7) of the swivel 12, enters into the hollow swivel, then into the hollow drill pipe "B", and to the bottom of the hole through holes in the bit. After the borehole is drilled to approximately half the length of the drill pipe "B", the drive of means designed for the rotation of the drill pipe "B" is again disengaged and the jaw chuck 13 is unclenched to release the pipe "B". To achieve the aforesaid, oil is supplied under the piston 31 to move the faceplate 34 and thus to unclench the jaws which move aside from the pipe "B" through the ports of spindle 24.

An idle run of the vertical traverse mechanism 8 then takes place, this mechanism moving from the lowermost position thereof to the uppermost position thereof. Then the chuck clamps the pipe "B" again, and the drives of the means designed for rotation of the drill pipe and of the pulldown unit designed for feeding the drill pipe to the bottom of the hole are engaged. Drilling proceeds to a preset depth.

On completing the making of the hole, the pulldown unit is switched from the working run to the idle run, and the means is disengaged.

On reaching the upper most position, the vertical traverse mechanism 8 automatically engages the clamp 14 to grip the pipe "B" while the jaw chuck 13 unclenches the pipe.

Thereafter the vertical traverse mechanism 8 is lowered idly to grip the pipe "B" again, the clamp 14 unclenching the pipe, and raises the pipe "B" for storage in the derrick to complete the making of the hole.

What is claimed is:

1. A portable drilling machine comprising: a crawler vehicle; a derrick installed on said vehicle and having longitudinal racks; a vertical traverse mechanism mounted on said longitudinal racks; a power-driven rotating jaw chuck for rotating a drill pipe positioned longitudinally in said derrick in alignment with a drilling axis and mounted in said vertical traverse mechanism, said jaw chuck serving as a traverse mounted in said vertical traverse mechanism, during a drilling operation said chuck grips said drill pipe and during an idle run, when said chuck is unclenched, said chuck and said verticle traverse mechanism regrip said drill pipe, which is now being held by a clamp located in a bottom portion of the derrick, said jaw chuck having a body, a hollow spindle on bearings mounted in said body, said drill pipe passing through said spindle, and jaws installed in radial ports of said spindle, said jaws being mounted on a faceplate surrounding said spindle, said chuck being rotated by means of a flexible coupling having an elastic shell connected to a flange rigidly attached to an outlet shaft of a reducing gear of a drive of a means for rotation of said chuck and to a bush connected through a spline to said spindle; a pulldown unit connected by a flexible transmission with said vertical traverse mechanism and said chuck to feed said drill pipe to the bottom of a hole during a working run of said vertical traverse mechanism and said chuck along said longitudinal racks, and to raise said drill pipe during an idle run; additional racks mounted on said derrick; and a swivel moving along said additional racks, being attached to the top of said drill pipe and connecting said hollow drill pipe with means for feeding a scavenging agent for cleaning cuttings from said hole.

2. A drilling machine in accordance with claim 1 wherein said pulldown unit comprises two drawworks each having a drive and brake drums, flexible transmission of said drawworks with said vertical traverse mechanism and said traverse being effected by means of a system of blocks and tackles.

* * * * *